United States Patent [19]

Clark et al.

[11] 4,450,907

[45] May 29, 1984

[54] CLEANING SYSTEM FOR PACKER REMOVAL

[75] Inventors: James M. Clark, Lafayette, La.; Tony M. Small, Houston, Tex.

[73] Assignee: Halliburton Company, Duncan, Okla.

[21] Appl. No.: 399,544

[22] Filed: Jul. 19, 1982

[51] Int. Cl.[3] ..... E21B 21/00

[52] U.S. Cl. ..... 166/223; 166/312

[58] Field of Search ..... 166/312, 311, 222, 223, 166/297, 301; 294/86.34

[56] References Cited

U.S. PATENT DOCUMENTS

| | | | |
|---|---|---|---|
| 2,839,143 | 6/1958 | Alexander | 166/301 |
| 3,020,957 | 2/1962 | Tausch | 166/301 X |
| 3,163,226 | 12/1964 | Lagucki | 166/312 X |
| 3,464,495 | 9/1969 | Childers et al. | 166/312 |
| 3,945,436 | 3/1976 | Nebolsine | 166/312 X |

*Primary Examiner*—Ernest R. Purser
*Assistant Examiner*—Thuy M. Bui
*Attorney, Agent, or Firm*—W. J. Beard

[57] ABSTRACT

This invention relates to a system for cleaning debris and precipitated materials from above a packer in a well bore. The tool includes a special overshot which attaches to a cut off tubing on a packer. The overshot has a closed off bore and a side opening which is coupled to a tubing string. A cleaning tool is pumped down the tubing and has a flexible tubing which passes through the side opening. Fluid can be circulated from the tubing to the annulus and remove precipitates. The cleaning tool has a collar location for position alignment.

3 Claims, 3 Drawing Figures

CLEANING SYSTEM FOR PACKER REMOVAL

BACKGROUND OF THE INVENTION

1. Field of the Invention

This invention relates to methods and apparatus for cleaning a well bore for the retrieval of a tool in a well bore. In particular, it relates to the cleaning of well bores above a packer to remove solids which may have precipitated out of well drilling fluids and which are deposited on the packer.

2. Description of Background

It is customary from time to time, in the production of a well to utilize a packer on a tubing string where the packer seals off the cross-section of a cased well bore and the packer bore directs the flow of fluids to a tubing string attached to the packer. In this arrangement there is an annular space created between the tubing string and the cased well bore. The well fluid in the annulus may contain solids in solution which, in time, precipitate out and settle or are deposited on the packer. If it is desired to remove the packer from the well bore, difficulties can arise because of the solids on the packer so that retrieval of the packer is difficult. If the packer is stuck in the well bore and can not be removed by manipulation of the tubing string, it is a practice to cut off the string of tubing at a location just above the packer and utilize a string of fishing pipe with a fishing overshot to attach to the cut off tubing string and remove the packer. However, many times it is difficult and impractical even to get an overshot on the tubing string above the packer because of the solids on the packer.

It is an object of this invention to provide a method and apparatus for removing precipitated solids from above a packer in a well bore to an extent necessary to enhance the removal of the packer and a retrieval operation for the packer.

BRIEF DESCRIPTION OF THE INVENTION

The present invention includes an apparatus which has a overshot on the end of a string of pipe where the overshot has a solid cross-section. A lower grapple bore is located below the solid cross-section and an upper fluid bore is located above the solid cross-section. The upper fluid bore communicates with the surface of the earth through the pipe string. Just above the solid cross-section in the overshot, the fluid bore has a side opening. A wire line cleaning tool is adapted to be passed through the pipe string and has a packer element for sealing off the cross-section of the pipe. Below the packer element is a flexible hose member, which is movable through the side opening in the overshot to be projected to a location above the packer element. The tool is also provided with a perforated pipe which provides a fluid communication path to the flexible hose member, a casing collar locator for locating the position of the tool and a conventional cable head for attachment to a wire line.

In the operation of the invention, the cleaning tool is lowered down the tubing. The flexible hose passes through the side opening and projects downwardly into the annulus between the packer and the cased well bore. The fluid passes through the perforated pipe and discharged from the hose to move the solids from above the packer into the fluid in the annulus so that the solids can be reverse circulated from the well bore. The positioning of the well tool is controlled by the wire line cable and the cleaning is conducted until the solids are sufficiently removed from the packer to permit retrieval of the packer.

BRIEF DESCRIPTION OF THE DRAWINGS

The invention will best be understood when taken in connection with accompanying drawings in which:

Referring now to FIG. 2, a cased well bore 10 traverses earth formations 11. A conventional releasable packer means 12 is disposed in the cased well bore and is attached to a tubing string 13. Normally the tubing string 13 would extend to the earth's surface so that the production of well fluids from below the packer would be transported to the earth's surface. In the illustration shown in FIG. 2, the tubing string 13 has been severed at the point 14 by a cutter in a well known manner so that the tubing string above the cut 14 can be retrieved. Normally the cutting and removal of the tubing string occurs when the packer means cannot be unset by manipulation of the tubing string. The accumulation of solids 15 which precipitate out of the well fluid 16 in the well bore 10 is sometimes a causitive factor in the inability to retrieve the packer means.

Figure 1:
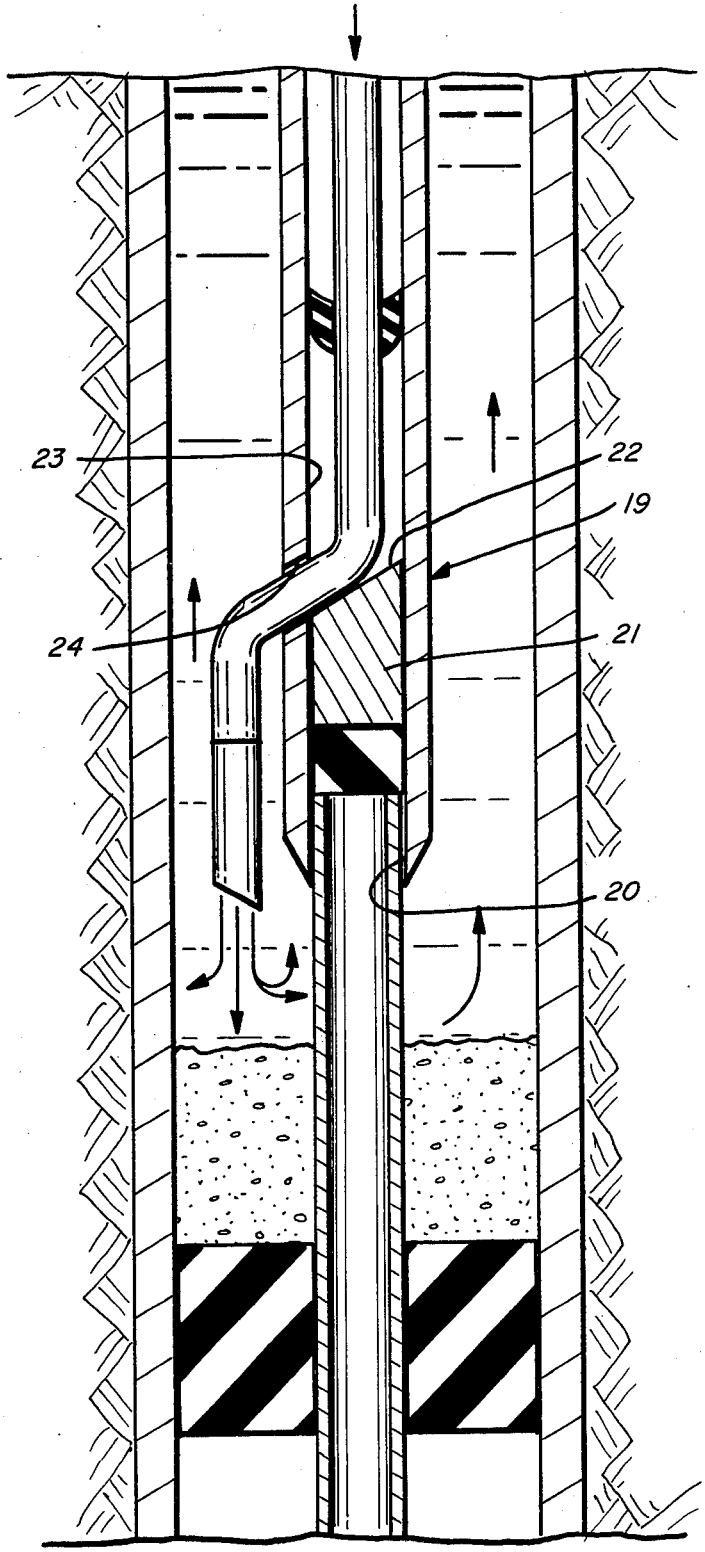
FIG. 1 is a schematic illustration of the present invention disposed in a well bore.

After it has been determined that the packer means 12 cannot be retrieved by manipulation of the tubing string 13 and after the string of tubing has been cut at the point 14, a pipe string 18 with an overshot 19 at its lower end is lowered into the well bore. The overshot has a conventional gripping mechanism (not shown) within an open lower end 20 which passes over the cut end of the tubing 13 and mechanically attaches to the string of tubing 13.

Figure 2:
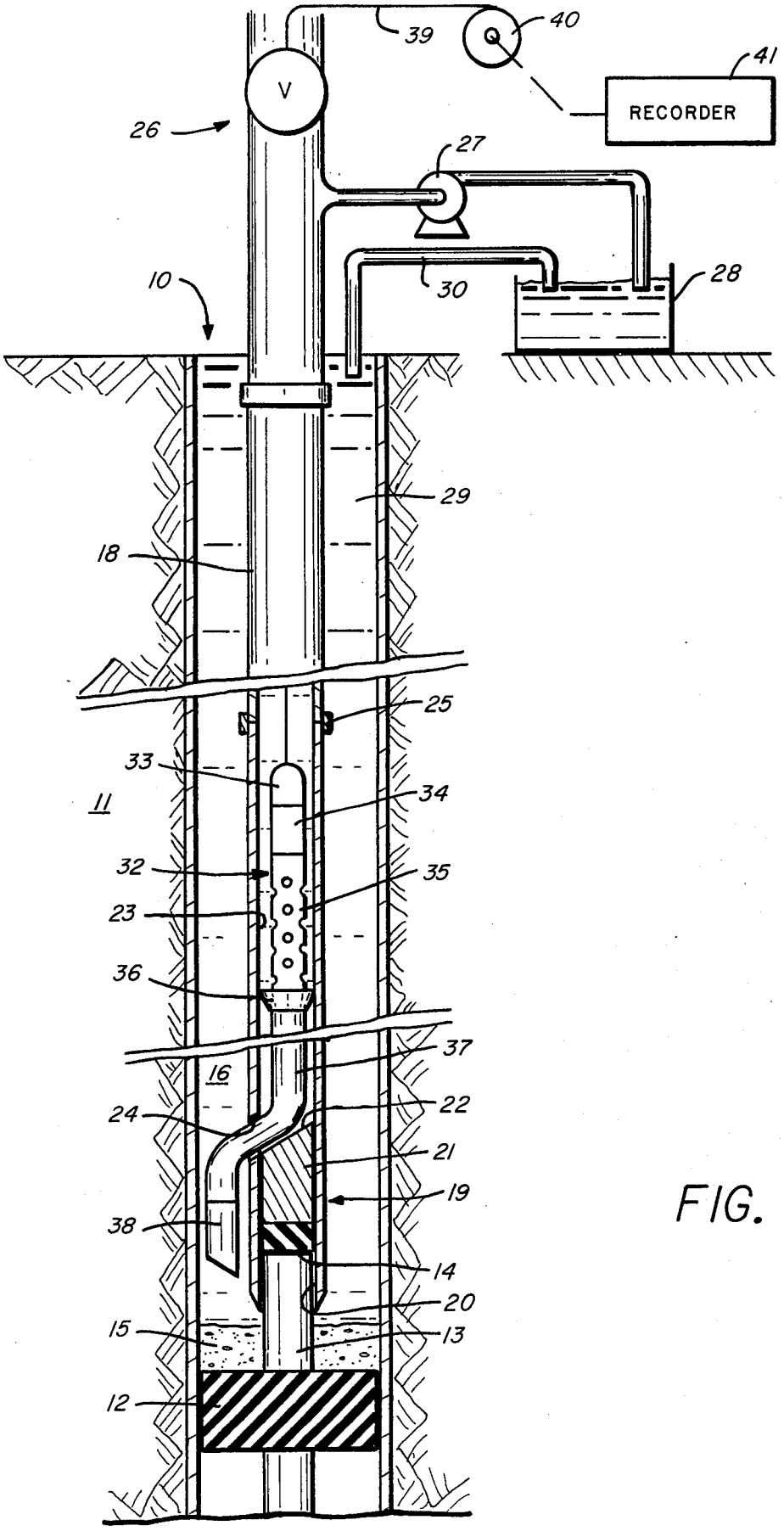
FIG. 2 schematically illustrates the cross-section of a packer in a well bore with a retrievable device in position.

As shown in FIGS. 1 and 2, the overshot 19 has a closed bore section 21 above the open lower end 20 and the closed bore section has an upper inclined surface 22 which connects an upper bore 23 to a side opening 24 in the overshot 19. The overshot 19 is in turn coupled by a pipe coupling 25 (FIG. 3) to a string of pipe 18 which extends to the earth's surface. The string of pipe 18 has coupling collars 25 disposed along its length which couple pipe sections to one another to form the string of pipe 18. At the earth's surface the pipe 18 is coupled to a christmas tree or control head 26. The control head 26 permits insertion of a well tool for the operation.

The pipe 18 is also coupled to a pump 27 which connects to a fluid tank 28. The annulus 29 between the tubing string 18 and the well bore 10 is also connected by a return pipe 30 to the fluid tank 28. Thus, there is a source of fluid under pressure at the earth's surface which can be pumped through the tubing 18 and the side opening 24 and returned via the annulus 29 to the earth's surface.

Figure 3:
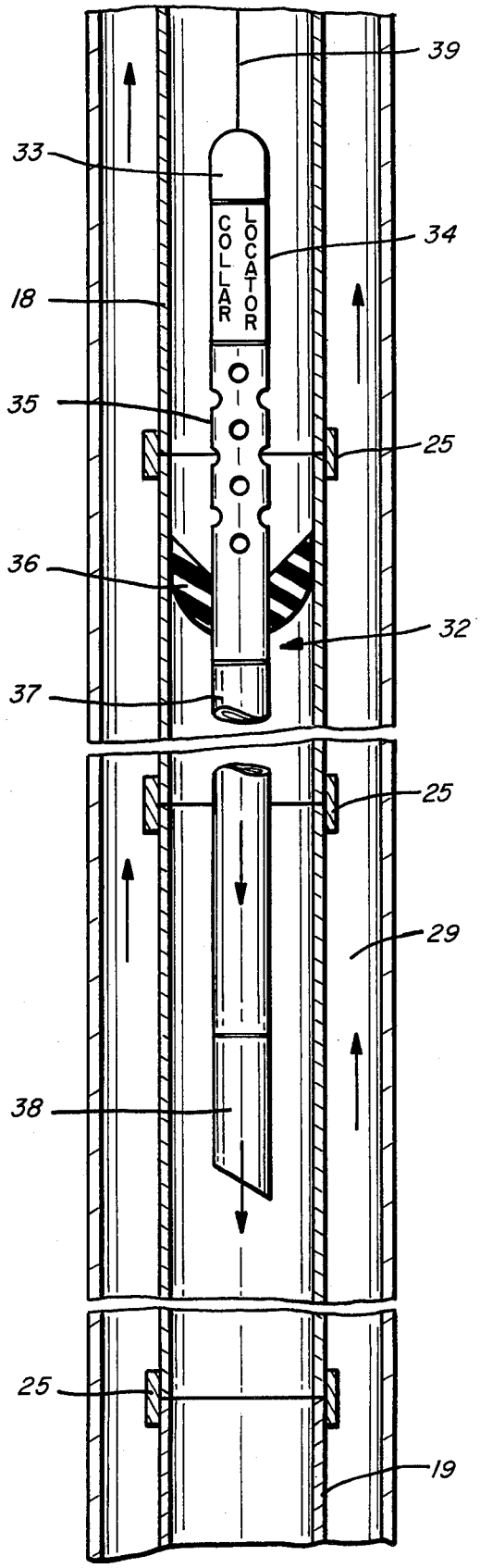
FIG. 3 illustrates a schematic cross-section and illustration of the cleaning tool used for insertion through the retrieving device.

The cleaning tool, as illustrated in FIG. 3 includes from top to bottom, a body member 32 having a cable head 33, a collar locator 34, a perforated pipe 35, a swab cup 36, a steel reinforced hose 37 and a flexible nozzle 38. The tool is inserted into the pipe string at the end of a wire line 39 which is coupled to a spooling winch 40 (FIG. 2) at the earths surface. Identification signals indicative of coupling collars 25 are obtained by the collar locator means 34 and transmitted to the earth's surface via the wire line 39 for recording on a recorder 41. The tool is inserted into the string of pipe 18 and is lowered via the wire line 39 to a desired depth. The collar locator will provide an indication of the location of the tool by counting the collars 25. Where the flexible nozzle 38 reaches the inclined surface 22, the nozzle and steel hose 37 are projected downwardly into the annulus 29. The perforated pipe 35 is in fluid communication with the hose 37 so that fluid under pressure is ejected from the nozzle 38. As the nozzle 38 approaches the solids 15 they are agitated and placed in the liquid where they can be circulated out of the well bore through the casing. Thus, the solids are removed from the location above the packer bore so that the packer 12 may be more easily retrieved.

The foregoing description may make other alternative arrangements according to the concepts of the present invention apparent to those skilled in the art. The aim of the appended claims therefore is to cover all such changes and modifications as are truly within the scope of the invention.

What is claimed is:

1. Apparatus for cleaning material from a location above a packer means in a well bore including:

an overshot means having a lower opening sized and constructed to be received over a cut end of a tubing string attached to a packer means;

said overshot means being adapted for coupling to a string of tubing and having a closed off bore portion above said lower open end, said overshot means having a bore above said closed end and said overshot means having an opening through its side in communication with said bore above said closed end;

a well cleaning tool adapted to be passed through a string of tubing attached to said overshot, said well cleaning tool having a depending flexible hose member below said packing means, said hose member being sized and constructed to pass through said opening in said overshot means;

means placing said hose member in fluid communication with the tubing above said packing means whereby fluid may be discharged through said hose to agitate materials into the fluid in the well bore annulus between the tubing string and well casing.

2. The apparatus as set forth in claim 1 wherein said overshot means has an inclined guiding surface connecting the tubing bore above the closed end to said opening.

3. The apparatus as set forth in claim 2 wherein said well cleaning tool includes a collar locator and a tubular perforated pipe above said packing means.

* * * * *